United States Patent [19]

Ohno et al.

[11] Patent Number: 4,962,745

[45] Date of Patent: Oct. 16, 1990

[54] FUEL SUPPLY DEVICE OF AN ENGINE

[75] Inventors: Eishi Ohno; Norihiko Nakamura, both of Mishima, Japan

[73] Assignee: Toyota Jidosha Kabushiki Kaisha, Aichi, Japan

[21] Appl. No.: 413,215

[22] Filed: Sep. 27, 1989

[30] Foreign Application Priority Data

Oct. 4, 1988 [JP] Japan ..... 63-249086
Feb. 7, 1989 [JP] Japan ..... 1-26658

[51] Int. Cl.[5] ..... F02G 5/00

[52] U.S. Cl. ..... 123/533; 123/572; 123/573

[58] Field of Search ..... 123/533, 572, 573, 574

[56] References Cited

U.S. PATENT DOCUMENTS

| | | | |
|---|---|---|---|
| 3,672,172 | 6/1972 | Hammond | 60/282 |
| 4,370,971 | 2/1983 | Bush | 123/573 |
| 4,401,093 | 8/1983 | Gates Jr. et al. | 123/573 |
| 4,462,760 | 7/1984 | Sarich et al. | 123/533 |
| 4,519,356 | 5/1985 | Sarich | 123/533 |
| 4,527,520 | 7/1985 | Koch | 123/533 |
| 4,528,969 | 7/1985 | Senga | 123/572 |
| 4,569,323 | 2/1986 | Okumura | 123/572 |
| 4,607,604 | 8/1986 | Kanoh et al. | 123/572 |
| 4,627,406 | 12/1986 | Namiki et al. | 123/573 |
| 4,674,462 | 6/1987 | Koch et al. | 123/533 |
| 4,693,224 | 9/1987 | McKay | 123/533 |
| 4,794,901 | 1/1989 | Hong et al. | 123/533 |
| 4,794,902 | 1/1989 | McKay | 123/533 |

FOREIGN PATENT DOCUMENTS

| | | | |
|---|---|---|---|
| 183936 | 4/1907 | Fed. Rep. of Germany . | |
| 725953 | 10/1942 | Fed. Rep. of Germany . | |
| 63-246411 | 10/1988 | Japan | 123/533 |
| 324656 | 1/1930 | United Kingdom . | |

OTHER PUBLICATIONS

Patent Abstract of Japan vol. 7, No. 137; June 15, 1983, No. 58-51213; Title: Exhaust Gas Purifier for Fuel Injection Type Internal-Combustion Engine with Supercharger.

*Primary Examiner*—Raymond A. Nelli
*Attorney, Agent, or Firm*—Oliff & Berridge

[57] ABSTRACT

A fuel supply device comprising an air compressor for supplying pressurized air to an air blast valve via a pressurized air passage, an oil supply device for supplying oil in an engine crankcase to the compressor, and an oil separator arranged in the pressurized air supply passage to separate oil from pressurized air discharged from the air compressor and return the thus-separated oil to the engine crankcase.

16 Claims, 6 Drawing Sheets

FUEL SUPPLY DEVICE OF AN ENGINE

BACKGROUND OF THE INVENTION

1. Field of the Invention

The present invention relates to a fuel supply device of an engine.

2. Description of the Related Art

In a known "air blast" valve, the opening and closing operation of a nozzle opening is electromagnetically controlled by a needle to inject fuel by pressurized air. The nozzle opening is formed on one end of an injection chamber, a pressurized air passage is connected to the other end of the injection chamber, and a fuel supply port is formed in the injection chamber between both ends thereof. After fuel is injected from the fuel supply port, the needle opens the nozzle opening, whereby the fuel thus injected is injected from the nozzle opening of the air blast valve together with pressurized air (see International Publication No. WO85/00854).

When an air compressor is used for supplying pressurized air to the air blast valve, the air compressor must be lubricated to prevent overheating and subsequent damage to the compressor. When, however, the air compressor is lubricated, the lubrication oil is contained in pressurized air discharged from the air compressor. Accordingly, a problem arises in that this ubrication oil flows into a combustion chamber from the air blast valve. Also, if the lubrication oil flows into the air blast valve, the lubrication oil forms a hardened layer in the valve. Furthermore, when the air compressor is lubricated with engine oil from the crankcase of an engine, a problem arises in that the consumption of engine oil is increased.

SUMMARY OF THE INVENTION

An object of the present invention is to provide a fuel supply device capable of lubricating the air compressor, preventing oil from flowing into the air blast valve, and preventing an increase in the consumption of the engine oil.

Therefore, according to the present invention, there is provided a fuel supply device of an engine having a crankcase, comprising: an air blast valve for injecting fuel by pressurized air; an air compressor for supplying pressurized air to the air blast valve via a pressurized air supply passage; an oil supply means for supplying oil in the engine crankcase to the air compressor to lubricate said air compressor; and an oil separator arranged in the pressurized air supply passage to separate oil from pressurized air discharged from the air compressor and return the thus-separated oil to the engine crankcase via a return passage.

The present invention may be more fully understood from the description of preferred embodiments of the invention set forth below, together with the accompanying drawings.

DESCRIPTION OF THE PREFERRED EMBODIMENTS

Figure 1:
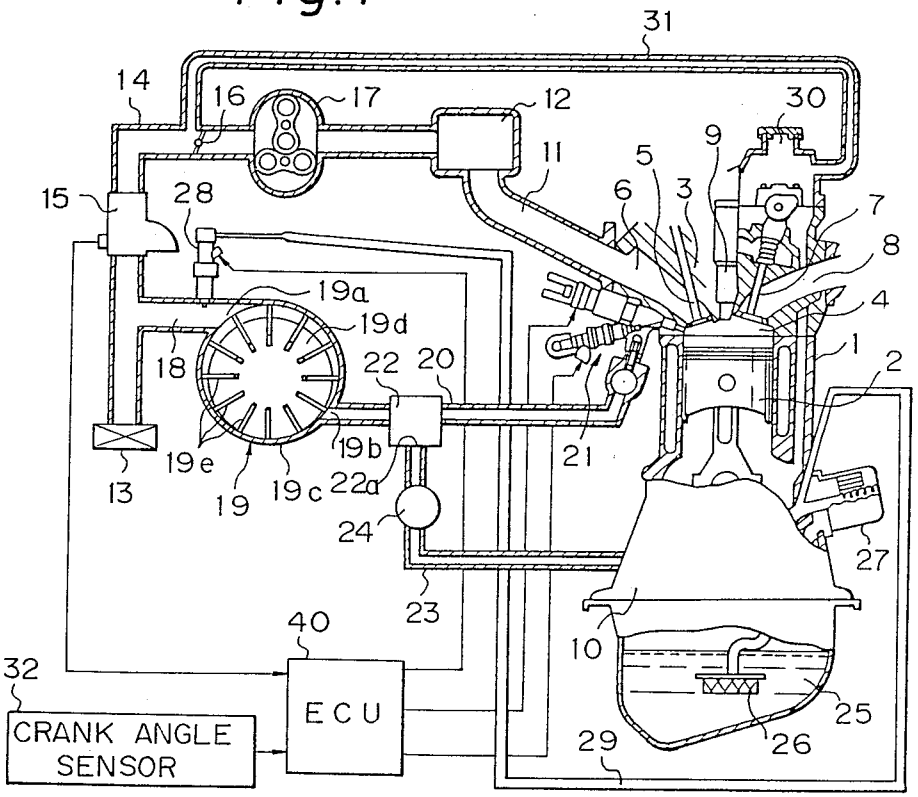
FIG. 1 is a schematic view of a two-stroke engine.

Referring to FIG. 1, reference numeral 1 designates a cylinder block, 2 a piston, 3 a cylinder head, 4 a combustion chamber, 5 a pair of intake valves, 6 intake ports, 7 a pair of exhaust valves, 8 exhaust ports, 9 a spark plug, 10 a crankcase, 11 an intake manifold, 12 a surge tank, and 13 an air cleaner. An intake pipe 14 connects the surge tank 12 and the air cleaner, and includes an air flow meter 15, throttle valve 16 and a supercharger 17 driven by an engine, arranged in this order from upstream of the intake pipe 14. A suction pipe 18 is branched from the intake pipe 14 between the air cleaner 13 and the air flow meter 15, and is connected to a suction port **19*a* of an air compressor 19, and a discharge port 19*b* of the air compressor 19 is connected to an air blast valve 21 via a discharge passage 20. The air compressor 19 is a vane type compressor, and comprises a cylinder 19*c*, a rotor 19*d* rotably offset in the cylinder 19*c*, and a plurality of vanes 19*e* slidably arranged in the rotor 19*d* to be able to move in the radial direction of the rotor 19*d*. The rotor 19*d* is driven by the engine and the tips of the vanes 19*e* slide on the inner circumferential face of the cylinder 19*d* when the rotor 19*d*** is rotated.

A oil separator 22 is arranged in a discharge passage 20, and has a drain port **22*a* connected to the crankcase 10 via a drain passage 23, wherein a pressure regulator 24 is arranged. The pressure regulator 24 allows a flow of pressurized air to the crankcase 10 when the pressure of pressurized air in the discharge passage 20 becomes higher than a predetermined pressure, whereby the pressure of pressurized air in the discharge passage 20** is maintained at a constant pressure, for example, 3 $kg/cm^2$.

Figure 2:
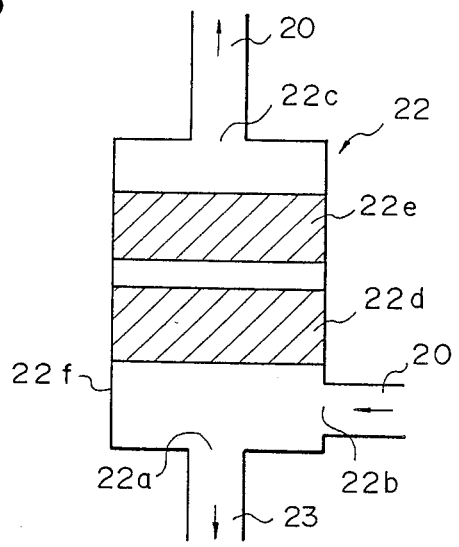
FIG. 2 is a schematic cross-sectional view of an oil separator.

FIG. 2 illustrates a schematic construction of the oil separator 22. Referring to FIG. 2, the drain port **22*a* is formed at the bottom of the casing 22*f* of the oil separator 22, an outlet port 22*c* is formed at the top of the casing 22*f*, and an inlet port 22*b* is formed at the lower side face of the casing 22*f*. The inlet port 22*b* is connected to the discharge port 19*b* of the air compressor 19 via the discharge passage 20 and the outlet port 22*c* is connected to the air blast valve 21 via the discharge passage 20. Two layers, for example, porous ceramic layers 22*d* and 22*e*, are arranged in the casing 22*f* between the inlet port 22*b* and outlet port 22*c*, and extend over an entire cross section of the interior of the casing 22*f*. Pressurized air, which contains engine oil, is discharged from the air compressor 19, and flows into the oil separator 22 via the inlet port 22*b***, and engine oil contained in pressurized air is separated from the air by the oil separator 22 while the pressurized air flows through the ceramic layers 22*d* and 22*e*. Therefore, very little oil is contained in the pressurized air which flows into the air blast valve 21 from the outlet port 22*c*. The oil separated in the oil separator 22 is returned to the engine crankcase 10 via the drain port 22*a* and the drain passage 23.

Returning to FIG. 1, engine oil 25 is collected at the lower portion of the engine crankcase 10. A strainer 26 is arranged in the engine oil 25 and the engine oil 25 is sent to a filter 27 via the strainer 26 by an oil pump (not shown). An oil injector 28 is arranged in the suction passage 18 near the air compressor 19 and is connected to the outlet of the filter 27 via an oil supply passage 29. Accordingly, a part of the engine oil 25 in the crankcase 10 is supplied to the oil injector 28 via the oil supply passage 29, and the oil injector 28 is electrically controlled to inject oil into the suction passage 18. The oil injected from the oil injector 28 is sucked into the air compressor 19 and lubricates all sliding parts thereof. Therefore, overheating of and damage to the sliding parts is prevented.

An upper space 30 of the engine is connected to the engine crankcase 10 and to the intake passage 14 near to and upstream of the throttle valve 16, via a blow-by gas exhaust passage 31. As pressurized air flowing into the engine crankcase 10 via the drain passage 23 is exhausted into the intake pipe 14 via the upper space 30 of the engine and the blow-by gas exhaust passage 31, the pressure in the engine crankcase 10 can not become excessively high. Also, since blow-by gas exhausted into the intake pipe 14 via the blow-by gas exhaust passage 31 is supplied to the combustion chamber by the supercharger 17, the blow-by gas is not emitted to the atmosphere.

The air flow meter 15 detects an amount of air fed into the cylinders 1, and signals output by the air flow meter 15 are input to the electronic control unit (ECU) 40. A crank angle sensor 32 generates pulses having a frequency proportional to the engine speed, and the pulses output by the crank angle sensor 32 are input to the ECU 40. The ECU 40 is also connected to a solenoid 50 and a fuel injector 56 (see FIG. 3) of the air blast valve 21 and the oil injector 28, and controls the air blast valve 21 and the oil injector 28 in accordance with the engine running conditions.

Figure 3:
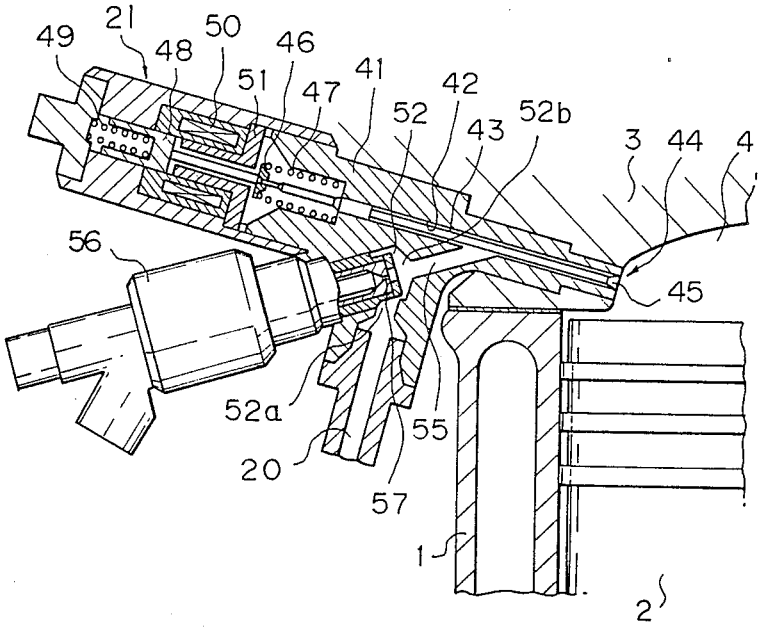
FIG. 3 is a partly cross-sectional side view of an air blast valve.

FIG. 3 illustrates a partly cross-sectional side view of the air blast valve 21.

Referring to FIG. 3, a straight needle insertion bore 42 is formed in the housing 41 of the air blast valve 21, and a needle 43 having a diameter smaller than that of the needle insertion bore 42 is inserted into the needle insertion bore 42. A nozzle opening 44 is formed at one end of the needle insertion bore 42, and the opening and closing operation of the nozzle opening 44 is carried out by the valve head 45 formed on the tip of the needle 43. In the embodiment illustrated in FIG. 3, the nozzle opening 44 is arranged in the combustion chamber 4. A spring retainer 46 is mounted on the needle 43, and a compression spring 47 is inserted between the spring retainer 46 and the housing 41. The nozzle opening 44 is normally closed by the valve head 45 of the needle 43 due to the spring force of the compression spring 47. A movable core 48 continuously abuts against the end portion of the needle 43, which is positioned opposite to the valve head 45, due to the spring force of the compression spring 47, and a solenoid 50 and a stator 51 are arranged in the housing 41 to attract the movable core 48. When the solenoid 50 is energized, the movable core 48 moves toward the stator 51. At this time, since the needle 43 moves toward the nozzle opening 44 against the compression spring 47, the nozzle opening 44 is opened.

A nozzle chamber 52 having a cylindrical shape is formed in the housing 41. The nozzle chamber 52 has an air inlet 52*a* and an air outlet 52*b* separately formed and spaced from the air inlet 52*a*. The air inlet 52*a* is connected to the discharge passage 20, and the air outlet 52*b* is connected to the needle insertion bore 42 via a pressurized air outflow passage 55. The nozzle 57 of a fuel injector 56 is arranged in the nozzle chamber 52 at a position between the air inlet 52*a* and the air outlet 52*b*.

As can be seen from FIG. 3, the pressurized air outlet passage 55 extends straight. The nozzle 57 of the fuel injector 56 is arranged on the axis of the pressurized air outlet passage 55, and fuel having a small spread angle is injected from the nozzle 57 along the axis of the pressurized air outflow passage 55. The pressurized air outlet passage 55 extends obliquely to the needle insertion bore 42 toward the nozzle opening 44 and is obliquely connected to the needle insertion bore 42 at an angle of 20 through 40 degrees with respect to the axis of the needle insertion bore 42.

The needle insertion bore 42, the nozzle chamber 52, and the pressurized air outflow passage 55 are connected to the air compressor (FIG. 1) via the discharge passage 20, and thus are filled with pressurized air. Fuel is injected into the pressurized air from the nozzle 57 along the axis of the pressurized air outflow passage 55. Since the pressurized air outflow passage 55 is obliquely connected to the needle insertion bore 42, a large part of the injected fuel reaches the interior of the needle insertion bore 42 around the needle 43 near the valve head 45. At this time, a part of the injected fuel adheres to both the inner wall of the pressurized air outflow passage 55 and the inner wall of the nozzle chamber 52. When the solenoid 50 is energized, the needle 43 opens the nozzle opening 44. At this time, since the injected fuel is collected near the valve head 45, both the fuel and the pressurized air are injected together from the nozzle opening 44 into the combustion chamber 4 as soon as the needle 43 opens the nozzle opening 44. In addition, when the needle 43 opens the nozzle opening 44, pressurized air flows into the nozzle chamber 52 from the discharge passage 20 and then flows toward the nozzle opening 44 via the pressurized air outflow passage 55. Consequently, the fuel adhered to the inner wall of the pressurized air outflow passage 55 and the inner wall of the nozzle chamber 52 is carried away by the pressurized air and then injected from the nozzle opening 44. Therefore, as soon as the needle 43 opens the nozzle opening 44, the entire injected fuel is injected from the nozzle opening 44 and, after the injection of the entire injected fuel is completed, only the pressurized air is injected from the nozzle opening 44. Then the solenoid 50 is deenergized, and thus the needle 43 closes the nozzle opening 44. Consequently, only the pressurized air is injected from the nozzle opening 44 immediately before the needle 43 closes the nozzle opening 44.

Returning to FIG. 1, engine oil supplied to the oil injector 28 via the oil supply passage 29 is injected from the oil injector 28 into the suction passage 18. The thus-injected fuel is sucked into the air compressor 19 and lubricates the sliding parts thereof, and therefore, overheating of and damage to the sliding parts is prevented.

Figure 4:
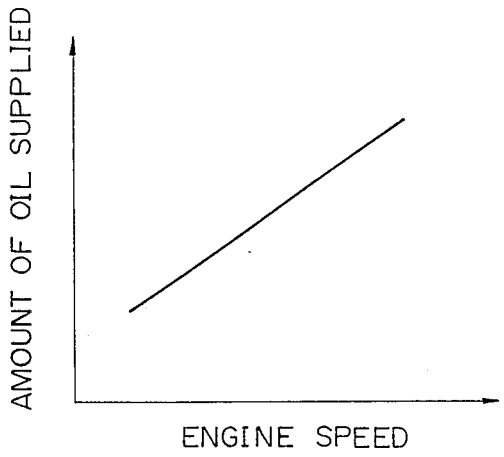
FIG. 4 illustrates the relationships between the engine speed and the amount of oil supplied to the air compressor.

As shown in FIG. 4, an amount of oil supplied to the air compressor 19 is increased in accordance with an increase of the engine speed. Namely, the amount of oil supplied is increased in accordance with an increase of the rotational speed of the air compressor 19.

Figure 5:
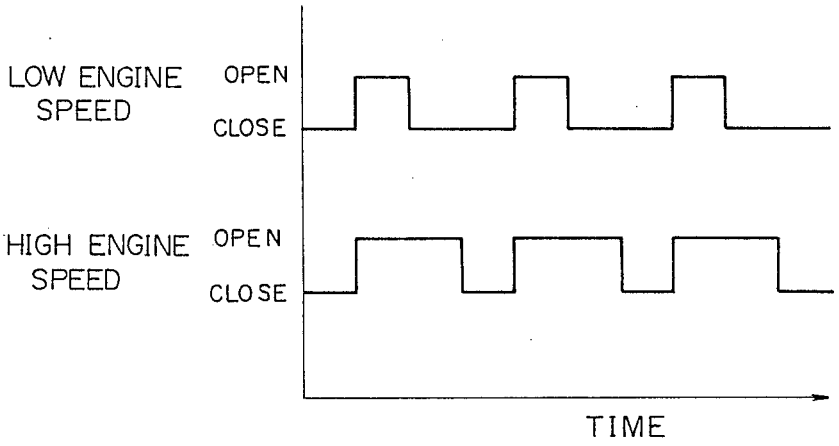
FIG. 5 is a time chart showing the operation of the oil injector.

FIG. 5 illustrates the operation of the oil injector 28. An amount of oil supplied to the air compressor 19 is controlled by the opening time of the oil injector 28, and the amount of oil supplied is increased in accordance with the opening time of the oil injector 28. Referring to FIG. 5, at a low engine speed, the amount of oil supplied is reduced by shortening the opening time of the oil injector 28, and at a high engine speed, the amount of oil supplied is increased by prolonging the opening time of the oil injector 28.

As most of the oil contained in the pressurized air discharged from the air compressor 19 is separated from the pressurized air by the oil separator 22, very little oil is contained in the pressurized air supplied to the air blast valve 21, and therefore, oil will not be deposited and hardened therein, and thus a change of the characteristics of the air blast valve 21 will not occur. Furthermore, since the oil separated by the oil separator 22 is returned to the engine crankcase 10 via the drain passage 23, the consumption of the engine oil is not increased.

Figure 6:
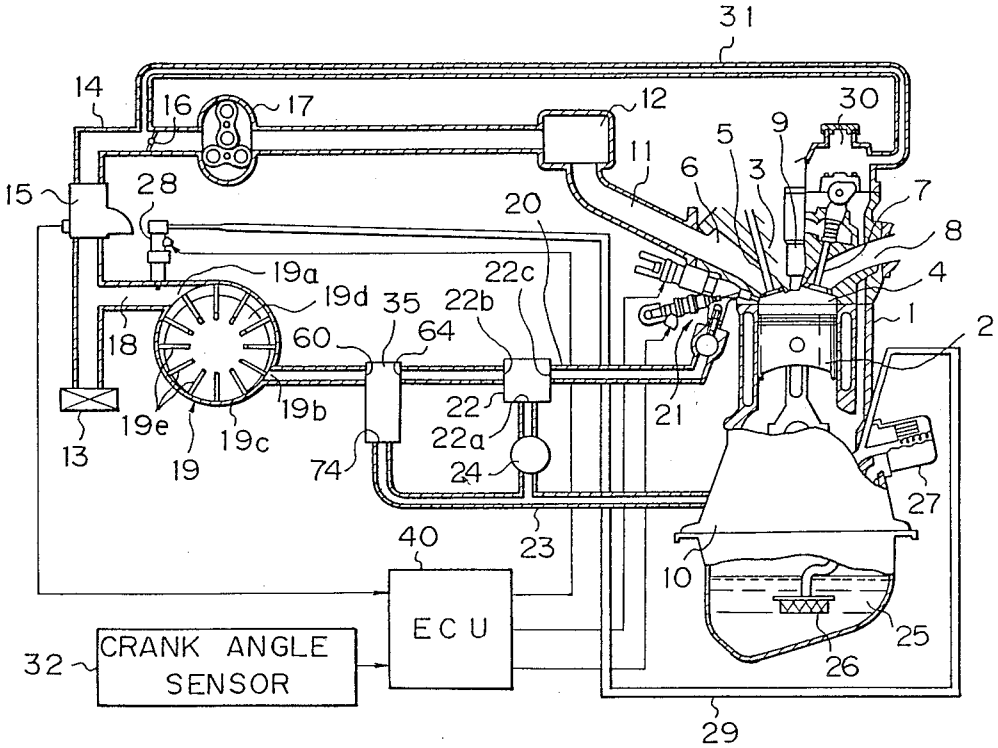
FIG. 6 is a schematic view of a two-stroke engine to which another embodiment of the fuel supply device is applied.

FIG. 6 illustrates another embodiment of the present invention. In FIG. 6, similar components are indicated by the same reference numerals as used in FIG. 1.

Referring to FIG. 6, an additional oil separator 35 is arranged in the discharge passage 20 between the air compressor 19 and the oil separator 22. This additional oil separator 35 separates only oil from the pressurized air, and thus only oil is exhausted from an oil drain port 74 of the additional oil separator 35 and is returned to the engine crankcase 10 via the drain passage 23.

Figure 7:
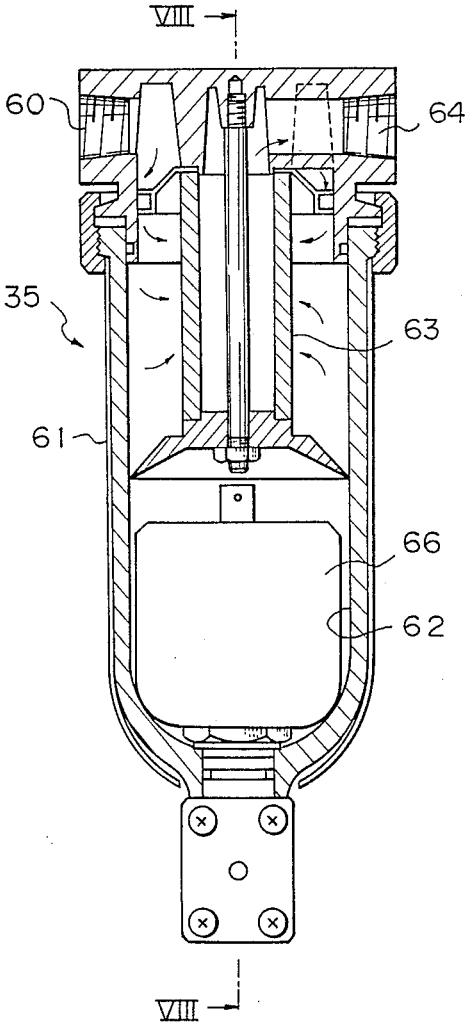
FIG. 7 is a cross-sectional view of an additional oil separator.
Figure 8:
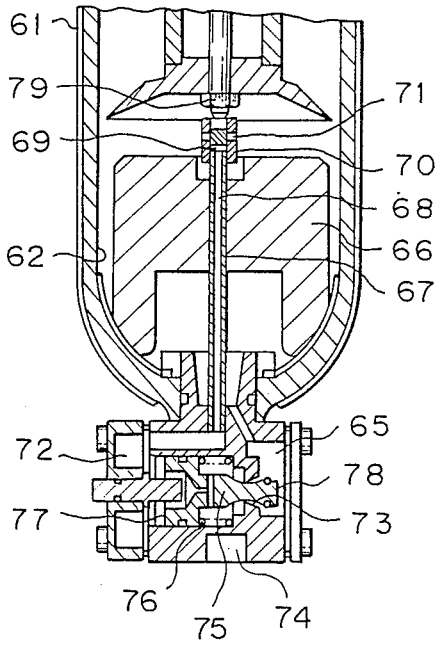
FIG. 8 is a cross-sectional view of the additional oil separator, taken along the line VIII—VIII in FIG. 7.
Figure 9:
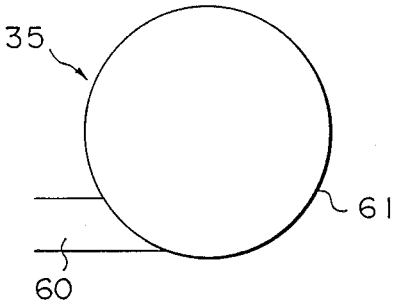
FIG. 9 is a schematic plan view of the additional oil separator.

FIGS. 7, 8, and 9 illustrate the additional oil separator 35. Referring to FIGS. 7, 8, and 9, the additional oil separator 35 comprises an inlet portion 60, an outlet portion 64, and the oil drain port 74. The inlet portion 60 is connected to the discharge port 19*b* of the air compressor 19 and the outlet portion 64 is connected to the inlet port 22*b* of the separator 22 (see FIG. 6). Referring to the figures, as the inlet portion 60 is connected at a tangent to an inner wall of a cylindrical separator housing 61, the pressurized air flows within the separator housing 61 while swirling along the inner wall of the separator housing 61, and oil contained in the pressurized air is separated from the pressurized air by a centrifugal force generated therein. The separated oil adheres to the inner circumferential wall of the separator housing 61 and is collected in a float chamber 62 formed at the lower portion of the separator housing 61. A filter 63 is arranged in the separator housing 61, coaxially therewith, and the pressurized air blows through the filter 63 to the outlet portion 64.

Referring to FIG. 8, an oil chamber provided below the float chamber 62 is continuously communicated with the float chamber 62. A float 66 is arranged in the float chamber 62, and a shaft 67 is fixed in the float 66 so that the shaft 67 extends through the float 66 along the center axis thereof. A longitudinal hole 68 extends along the axis of the shaft 67 from the bottom end to the top portion thereof, and is connected to a diametric hole 69 extending along the diameter of the shaft 67. The top portion of the shaft 67 is introduced into a cap 70 which is axially movable on the shaft 67. A through hole 71 extends along the diameter of the cap 70. When the float 66 is in a lower position, the diametric hole 69 is not communicated with the through hole 71, and accordingly, the longitudinal hole 68 is not communicated with an inner portion of the separator housing 61. The longitudinal hole 68 is continuously communicated with a pressure chamber 72 at the bottom end of the shaft 67. A valve 75 opening and closing a valve port 73 is arranged in the valve port 73, and when the valve 75 opens the valve port 73, the oil chamber 65 is communicated with the oil drain port 74 via the valve port 73. The valve 75 is continuously urged to the left in the figure, by a compression spring 76, so that the valve 75 closes the valve port 73. The area of the left end 77 of the valve 75 is larger than the area of the right end 78 of the same. The left end 77 of the valve 75 is pressed to the right by the pressure of the pressurized air in the pressure chamber 72, and the right end 78 of the valve 75 is pressed to the left by the pressure of the oil in the oil chamber 65.

Referring to FIG. 7, the pressurized air, which contains oil, is discharged from the air compressor 19 (FIG. 6) and flows into the additional oil separator 35 via the inlet portion 60, and flows out of the additional oil separator 35 via the outlet portion 64. The additional oil separator 35 separates oil from the pressurized air by centrifugal force and the force of gravity, and accordingly, almost all of the oil is separated from the air by the additional oil separator 35, even when a large amount of oil is contained in the pressurized air. Note, not all of the oil contained in the pressurized air can be separated therefrom, for example, 97% of the oil contained in the pressurized air can be separated therefrom, and therefore, a small amount of oil is contained in the pressurized air flowing out of the outlet portion 64.

Referring to FIG. 8, when oil is collected in the float chamber 62 and the float 66 is floated, the shaft 67 moves upward with the float 66, whereby the cap 70 is engaged with a stopper 79. When the amount of oil collected in the float chamber 62 is increased, and thus the float 66 is moved further upward, the shaft 67 moves relative to the cap 70 and the diametric hole 69 is communicated with the through hole 71, and therefore, the pressurized air in the separator housing 61 is introduced into the pressure chamber 72 via the longitudinal hole 68. Since the area of the left end 77 of the valve 75 is larger than the area of the right end 78 thereof, the force operating on the left end 77 is larger than the force operating on the right end 78, and accordingly, the valve 75 is moved to the right and opens the valve port 73, whereby the oil collected in the float chamber 62 is allowed to flow into the drain passage 23 via the oil chamber 65, the valve port 73 and the oil drain port 74. When the oil in the float chamber 62 flows out therefrom, the float 66 moves downward, and therefore, the diametric hole 69 is not in communication with the through hole 71, and thus the pressure chamber 72 is not in communication with the inner portion of the separator housing 61. At this time, since the pressure chamber 72 is communicated with the oil drain port 74, the pressure in the pressure chamber 72 is reduced, and therefore, since the force operating on the left end 77 is reduced, the valve 75 is moved to the left and shuts the valve port 73. As mentioned above, with the above process, only separated oil is returned to the engine crankcase 10 via the oil drain port 74 and the drain passage 23.

In this embodiment, even if a large amount of fuel is discharged together with the pressurized air from the air compressor 19, most of the oil contained in the pressurized air can be separated therefrom by the two oil separators 22 and 35.

Also, since most of the oil contained in the pressurized air is separated by the additional oil separator 35, only a little oil flows into the pressure regulator 24, and therefore an abnormal operation of the pressure regulator 24 due to oil flowing therein is prevented.

Although an oil separation rate in the oil separator 22 is increased in accordance with an increase of the amount of air released by the pressure regulator 24, since a large part of the oil contained in the pressurized air is separated by the additional separator 35, most of the oil contained in the pressurized air can be separated even if a small amount of air is released by the pressure regulator 24.

While the invention has been described with reference to specific embodiments chosen for purposes of illustration, it should be apparent that numerous modifications could be made thereto by those skilled in the art without departing from the basic concept and scope of the invention.

We claim:

1. A fuel supply device of an engine having a crankcase, comprising:

an air blast valve for injecting fuel by pressurized air;

an air compressor for supplying pressurized air to said air blast valve via a pressurized air supply passage;

an oil supply means for supplying oil in the engine crankcase to said air compressor to lubricate said air compressor;

an oil separator arranged in said pressurized air supply passage to separate oil from pressurized air discharged from said air compressor and return said thus-separated oil to the engine crankcase via a return passage; and a pressure regulator arranged in said return passage for discharging pressurized air and separated oil to said crankcase when a pressure in said pressurized air supply passage becomes higher than a predetermined pressure and for stopping the discharge of pressurized air and separated oil to said crankcase when said pressure in said pressurized air supply passage becomes lower than said predetermined pressure, to keep said pressure in said pressurized air supply passage at a constant value and to discharge said separated oil to said crankcase.

2. A fuel supply device according to claim 1, wherein said oil separator separates oil together with a part of said pressurized air.

3. A fuel supply device according to claim 2, wherein said oil separator comprises a porous ceramic layer for separating oil from pressurized air passing through said ceramic layer toward said air blast valve.

4. A fuel supply device according to claim 3, wherein said oil separator comprises an inlet port for introducing pressurized air into said oil separator, an outlet port for allowing a flow of pressurized air out of said oil separator to said air blast valve, and a drain port for draining separated oil and a part of said pressurized air, said ceramic layer being arranged between said inlet port and said outlet port, and said drain port being located on a same side as said inlet port with respect to said ceramic layer.

5. A fuel supply device according to claim 2, further comprising an additional oil separator arranged in said pressurized air supply passage to separate oil from said pressurized air.

6. A fuel supply device according to claim 5, wherein said additional oil separator is arranged between said air compressor and said oil separator.

7. A fuel supply device according to claim 6, wherein said additional oil separator separates only oil from said pressurized air, and said oil separated by said additional oil separator is returned to the engine crankcase from a drain port of said additional oil separator.

8. A fuel supply device according to claim 7, wherein said additional oil separator intermittently drains separated oil to return said separated oil to the crankcase.

9. A fuel supply device according to claim 8, wherein said additional oil separator drains said separated oil when an amount of said separated oil reaches a predetermined amount.

10. A fuel supply device according to claim 9, wherein said additional oil separator comprises a float chamber for collecting separated oil, a float arranged in said float chamber, and a valve arranged in an oil passage connecting said float chamber and said drain port, and said valve is controlled by said float so that said valve is opened when the amount of separated oil collected in said float chamber reaches a predetermined amount and an amount of displacement of said float reaches a predetermined value.

11. A fuel supply device according to claim 5, wherein said additional oil separator separates oil by centrifugal separation.

12. A fuel supply device according to claim 1, wherein said oil supply means supplies oil to a suction passage of said air compressor.

13. A fuel supply device according to claim 1, wherein said oil supply means comprises an electric oil injector.

14. A fuel supply device according to claim 1, wherein said air compressor is driven by the engine.

15. A fuel supply device according to claim 14, wherein said oil supply means increases an amount of oil supplied in accordance with an increase of an engine speed.

16. A fuel supply device according to claim 1, wherein said air compressor is a vane type compressor.

* * * * *